United States Patent [19]

Kondur, Jr.

[11] 4,238,160

[45] Dec. 9, 1980

[54] MEDIA GUIDE

[75] Inventor: Nicholas Kondur, Jr., Riverton, Wyo.

[73] Assignee: C. Itoh Electronics, Inc., Los Angeles, Calif.

[21] Appl. No.: 912,088

[22] Filed: Jun. 2, 1978

[51] Int. Cl.[3] ..... B41J 15/00

[52] U.S. Cl. ..... 400/616.3; 400/616.1; 226/82

[58] Field of Search ..... 400/120, 124, 126, 616, 400/616.1, 616.2, 616.3, 619, 642, 643, 645; 226/74, 75, 76, 77, 78, 79, 80, 81, 82, 83, 84, 85, 86, 87; 101/93.05, 93.29

[56] References Cited

U.S. PATENT DOCUMENTS

| | | | |
|---|---|---|---|
| 840,384 | 1/1907 | Scoggin | 400/619 X |
| 2,622,476 | 12/1952 | Ress | 226/86 X |
| 3,317,102 | 5/1967 | Lizotte | 400/616.1 X |
| 3,762,618 | 10/1973 | Derossi | 226/76 |
| 3,787,884 | 1/1974 | Demer | 400/126 X |
| 3,787,886 | 1/1974 | McCrady | 400/616.1 X |
| 3,795,298 | 3/1974 | Kodis | 400/124 |
| 3,825,162 | 7/1974 | Hubbard | 226/74 |
| 3,831,829 | 8/1974 | Karpisek | 226/83 |
| 3,855,448 | 12/1974 | Hanagata et al. | 400/120 X |
| 3,986,594 | 10/1976 | Kondur, Jr. | 400/124 |
| 4,004,671 | 1/1977 | Kondur, Jr. | 101/93.05 X |
| 4,062,436 | 12/1977 | Kondur, Jr. et al. | 400/124 |
| 4,070,963 | 1/1978 | Weaver | 101/93.29 |
| 4,088,256 | 3/1978 | Potma et al. | 226/74 |

FOREIGN PATENT DOCUMENTS

| | | | |
|---|---|---|---|
| 467567 | 8/1950 | Canada | 400/616.3 |
| 745757 | 2/1956 | United Kingdom | 400/642 |

*Primary Examiner*—Ernest T. Wright, Jr.
*Attorney, Agent, or Firm*—W. Edward Johansen

[57] ABSTRACT

The present invention is a guide for use in combination with a printer which includes a frame and a print head that is mechanically coupled to the frame and that is adapted to travel laterally along the front of the frame. The printer also includes a platen which is mechanically coupled to the frame and which is disposed so that a print medium may travel between the platen and the print head, and a pair of sprockets, each of which has a cylindrical sidewall on which the print medium travels. Each of the sprockets has a disc-shaped hub and is axially coupled to the frame. The media guide includes a pair of integral members each of which is disposed adjacent to one of the sprockets so that the print medium is disposed between the cylindrical sidewall of the sprocket and has a first portion which is mechanically coupled to the disc-shaped hub of the sprocket adjacent to a second portion of the integral member so that each of the sprockets may rotate independently of each of the integral members. Each of the integral members has a pair of fingers which are mechanically coupled to the disc-shaped hub of each of the sprockets and is biased by a spring which resiliently couples the pair of fingers.

6 Claims, 5 Drawing Figures

MEDIA GUIDE

BACKGROUND OF THE INVENTION

1. Field of the Invention

The present invention relates to a media guide for use in combination with a printer.

2. Description of the Prior Art

U.S. Pat. No. 4,088,256, entitled Device for Printing Data, issued to Theodorus Gerhardus Potma, Egbertus Nicholas Bijkerk and Marius Ouirijnen on May 9, 1978, teaches a paper guide which cooperaes with the section of a chart after it has been disengaged from a first and second pair of tractors.

U.S. Pat. No. 3,825,162, entitled Feed Mechanism, issued to Leo J. Hubbard on July 23, 1974, teaches a mechanism for feeding documents having perforations along their marginal edges which has frames that define linear paths for endless belts for curvilinear motion around and away from the ends of the linear paths. The belts have unitary pin and roller drive elements which extend through perforations in the belts at equidistant intervals theralong. The feed mechanism includes sprockets which are supported by the frame and journaled therein in order to carry the belts around the curvilinear paths.

U.S. Pat. No. 3,825,162 also teaches a media guide which secures the perforated print medium between itself and the endless belt of each drive mechanism. This media guide is a rectangular member which has a rectangular slot running longitudinally through its centerline in order to be lined up with the linear path of the unitary pins. It is not practical to use this media guide when the print medium does not travel in a linear path.

U.S. Pat. No. 3,795,298, entitled Wire Matrix Print Head Particularly For High Speed Printer, issued to Robert D. Kodis on Mar. 5, 1974, shows a paper guide as do both U.S. Pat. No. 3,855,448 and U.S. Pat. No. 3,787,886.

U.S. Pat. No. 3,787,884 entitled Ink Jet Printer, issued to Frederick M. Demer on Jan. 22, 1974, teaches a paper guide plate which curves upward at the front of an ink jet printer and extends across the ink jet printer. This paper guide has three spring fingers which hold the paper against the platen bar.

None of the above-mentioned media guides are of a simple construction. They all have too many components and are therefore expensive to manufacture and to maintain.

SUMMARY OF THE INVENTION

In view of the foregoing factors and conditions characteristic of the prior art, it is a primary object of the present invention to provide a media guide which maintains the print medium in constant engagement with the pins of a pair of sprockets so that the print medium may move through the printer.

It is another object of the present invention to provide a media guide which also functions in concert with a media advancement mechanism, having a pawl and a media feed solenoid, as a friction clutch engaging the sprockets of the printer so that the sprockets do not turn inadvertently while the pawl is being operated by the media feed solenoid.

It is still another object of the present invention to provide a media guide that is of a very simple construction, but that still provides several useful mechanical functions.

It is yet another object of the present invention to provide a media guide that is easy to use so that a print medium may be changed quickly and efficiently.

In accordance with the preferred embodiment of the present invention a media guide for use in combination with a printer is described. The printer includes a frame and a print head that is mechanically coupled to the frame and that is adapted to travel laterally along the front of the frame. The printer also includes a platen which is mechanically coupled to the frame and which is disposed so that a print medium may travel between the platen and the print head, and a pair of sprockets, each of which has a cylindrical sidewall on which the print medium travels. Each of the sprockets has a disc-shaped hub and is axially coupled to the frame.

The media guide includes a pair of integral members each of which is disposed adjacent to one of the sprockets so that the print medium is disposed between the cylindrical sidewall of the sprocket and has a first portion which is mechanically coupled to the disc-shaped hub of the sprocket adjacent to a second portion of the integral member so that each of the sprockets may rotate independently of each of the integral members. Each of the integral members has a pair of fingers which are mechanically coupled to the disc-shaped hub of each of the sprockets and is biased by a spring which resiliently couples the pair of fingers.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
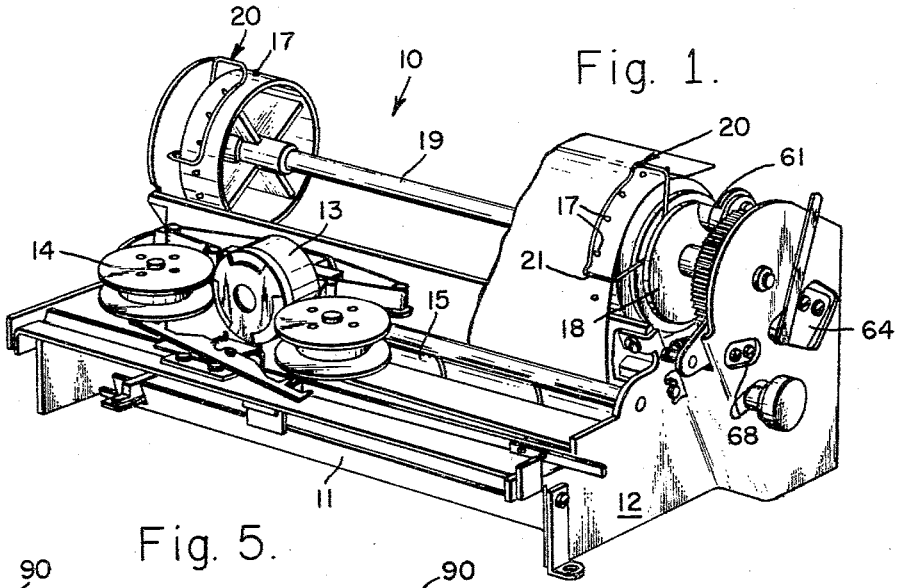
FIG. 1 is a perspective drawing of a printer which includes a frame, a print head and a platen for use in combination with a media guide which has been constructed in accordance with the principles of the present invention.

In order to best understand the present invention it is first necessary to read the foregoing description of a printer which is to be used in combination with the present invention and also to refer to the figures in the accompanying drawing. Referring to FIG. 1 a printer 10 includes a frame 11 having a platen **11*a*, a pair of side plates 12 and a print head 13 which is adapted to travel laterally across the front of the frame 11. The print head 13 uses an inked ribbon 7 and is of a type which is taught in U.S. Pat. No. 4,004,671, entitled Wire Matrix Print Head, issued to Nicholas Kondur, Jr. on Jan. 25, 1977. Other U.S. Pats. that teach similar print heads include: No. 4,070,963, No. 3,986,594 and No. 4,062,436. The printer 10 also includes an inking apparatus 14 which is mechanically coupled to the print head 13 in order to provide ink for printing onto a print medium 8, and a timing shaft 15 which is rotatably coupled to the frame 11 between the pair of side plates 12 and which is mechanically coupled to the print head 13 and the inking apparatus 14 in order to drive them in concern across the front of the frame 11. The print medium 8 may be paper with sprocket holes 9 spaced a standardized distance apart along its borders. The printer 10 further includes a pair of sprockets 16, each of which is a disc-shaped member having a plurality of pins 17 which are disposed on its cylindrical sidewall and are spaced apart the same distance as are the sprocket holes 9 of the paper 8 and also having a disc-shaped hub 18, and a sprocket shaft 19 which is rotatably coupled to the frame 11 between the pair of side plates 12 and which mechanically couples each of the sprockets 16 adjacent to one of the side plates 12, and a pair of media 8 guides 20 each of which is mechanically coupled to the disc-shaped hub 18 of one of the sprockets 16 so that the print media 8 is disposed between it and the cylindrical sidewall of the sprocket 16**.

Still referring to FIG. 1 the inking apparatus 14 is similar to the one taught in U.S. Pat. No. 3,986,594, entitled Serial Impact Calculator Printer, issued to Nicholas Kondur, Jr. on Oct. 19, 1976.

Figure 3:
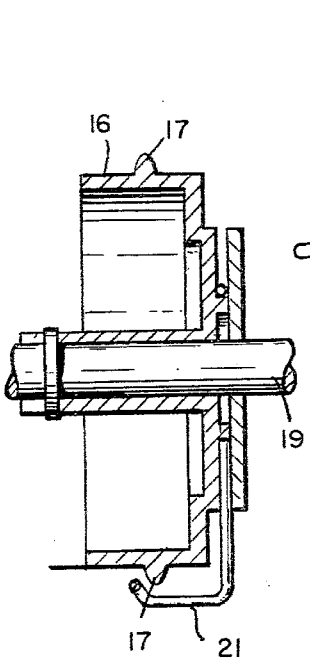
FIG. 3 is a cross-sectional view of the sprocket of FIG. 2 showing the media guide mechanically coupled thereto.
Figure 2:
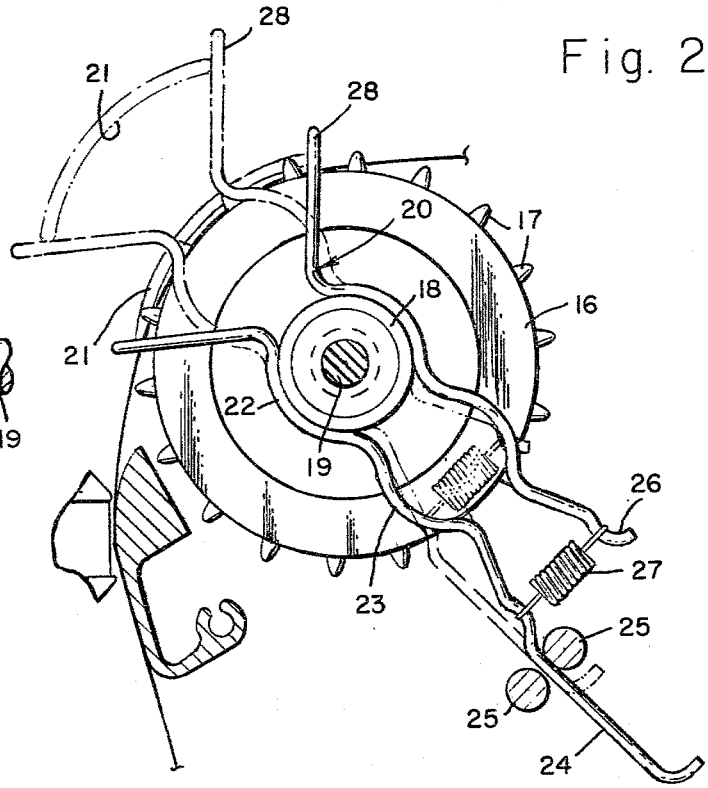
FIG. 2 is a partial side elevational view of a sprocket of the printer of FIG. 1 and the media guide.

Referring now to FIG. 2 in conjunction with FIG. 3 each media guide 20 is an integral member which has a first portion 21, which is disposed adjacent to the sprocket 16 so that the print media 8 is disposed between it and the cylindrical sidewall of the sprocket 16 and a second portion 22 which is adapted to be frictionally coupled around the disc shaped hub 18 of the sprocket 16 so that the sprocket 16 may rotate independently of the media guide 20. Each media guide 20 has a third portion 23 which is in the same configuration as the second portion 22 thereof and which is disposed adjacent to the second portion 22 so that when the first portion 21 of the media guide 20 is lifted up in order to remove the print media 8 the third portion 23 is frictionally coupled around the hub 18 of the sprocket 16. The third portion 23 has a first finger 24 which is disposed between and slideably coupled to a pair of parallel bars 25 so that the media guide 20 cannot rotate, and a second finger 26. A spring 27 resiliently couples the first finger 24 to the second finger 26.

Figure 4:
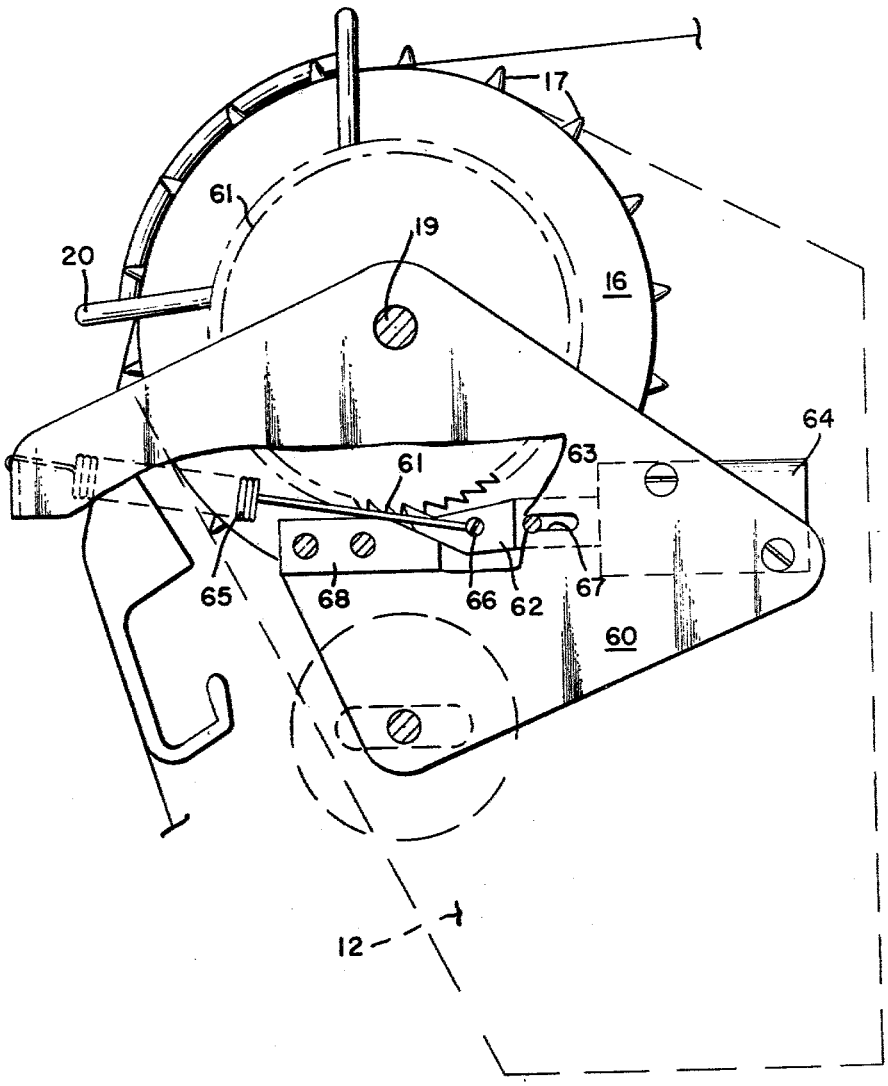
FIG. 4 is a partial side elevational view of the printer of FIG. 1 showing the media guide in cooperation with the media advancement mechanism of the printer.

Each media guide 20 also includes a fourth portion 28 which is adjacent to the first portion 21 and which is adapted so that an operator may insert his fingers therein. The media guide 20 is designed so that its two primary functions are achieved. Its first function is to maintain the print medium 8 in engagement with the pins 17 and the cylindrical sidewall of the sprocket 16 so that print medium 8 may move through the printer 10. The first portion 21 of each media guide 20 is spaced closely to the cylindrical sidewall of one of the sprockets 16 so as to prevent the print medium 8 from media becoming disengaged from the pins 17. The clearance between the cylindrical sidewall of the sprocket 16 and the first portion 21 of the media guide 20 is significantly less than the height of the pins 17. Adequate clearance between the inner surface and the first portion 21 is necessary in order to prevent "jamming" of the print medium 8. Its second function is to act as a friction clutch on the hubs of the sprockets 16. Each media guide 20 is maintained in its rest position by the action of its second portion 22 partially circumscribing the hub 18. Since the media guide 20 is made from a resilient material, it maintains its shape around the hub 18 and acts as a friction clutch on the hub 18 because in its unconnected condition the diameter of the second portion of each media guide 20 is smaller than the diameter of the hub 18. In order to show how easily the sprocket holes 9 of the print medium 8 engages the pins 17 of the sprocket 16, a second position of the media guide 20 is shown in phantom lines in FIG. 2. In this second position the media guide 20 permits the operator easy access to the pins 17 by removing its first portion 21 from close juxtaposition to the cylindrical sidewall of the sprocket 16. This second position is maintained, until the operator decides to restore the media guide 20 to its rest position. The spring 27 permits, by selection of various tensions, the adjustment of the friction clutch action of the diameters of the second and third portions 22 and 23 on the hub 18 of the sprocket 16. The parallel bars 25 in concert with a fifth portion 29 of the media guide 20 prevent the operator from inadvertantly extracting the media guide 20 from the printer 10. The parallel bars 25 will stop the first finger 24 if the media guide 20 is pulled slightly beyond the open position. The fixed parallel bars 25 also prevent rotation of media guide 20 around the hub 18 in order to maintain the media guide's angular relationship to the print media 8. A disc-shaped side plate 30 of the sprocket 16 in FIG. 1 prevents the media guide 20 from moving axially as does the side surface of the sprocket 16. A step **16*a* in the side surface of the sprocket 16 is to provide for clearance for the spring 27 when the media guide 20 is in the open position. Referring to FIG. 4 the printer 10 further includes an adjustment plate 60 which is disposed orthogonally to the sprocket shaft 19 and adjacent to a ratchet wheel 61. A pawl 62 is mechanically coupled to an armature 63 of a media feed solenoid 64, which is mounted on the adjustment plate 60, and it engages each successive tooth of the ratchet wheel 61 thereby incrementing the print medium 8**.

Still referring to FIG. 4 the media drive mechanism includes the operation of the media guide 20 in cooperation with the cylindrically shaped hub 18 of the sprocket 16 to provide a friction clutch. This friction clutch action is necessary so that sprocket 16 does not rotate inadvertently when the pawl 62 is operated by the media feed solenoid 64 during the incrementing of the print medium 8. This inadvertent rotation may be caused by two factors. First, if the print 8 media extends downward from the printer 10 for a considerable distance as in a case where the printer 10 is placed on a table with the media supply on the floor, it will exert a counterclockwise force on the sprocket 16 so that the pawl 62 is moved out of its "jamming" engagement with the pawl stop 68. This will cause the ratchet wheel 61, along with the sprocket 16 and the media 8 to be rotated by the weight of the media 8. This in turn will cause either a misalignment of the printing on the media 8 or a failure of the pawl 62 to engage the next ratchet tooth of the ratchet wheel 61. Second, the tip of the pawl 62 exerts a rotational force on the ratchet wheel 61 which is due to the action of the spring 65 when pawl 62 is actuated by the media feed solenoid 64. This rotational force may be sufficient to cause a counterclockwise rotation of the sprocket 16 with the same consequences as the first factor.

Figure 5:
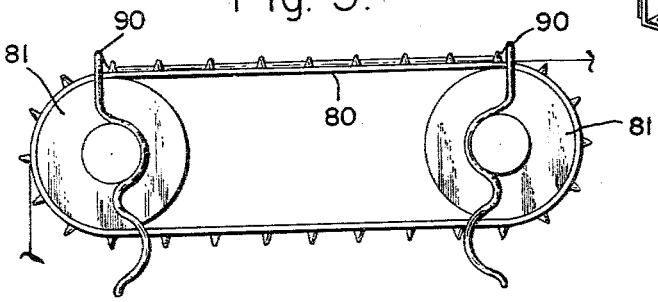
FIG. 5 is a side elevational view of a tractor driven apparatus for advancing a print medium.

Referring now to FIG. 5 a second type of media advancement mechanism includes an endless loop 80 such as a chain or a belt and a first cylindrical member 81 and a second cylindrical member 82 each of which is adapted to rotate about its axis and one of which is adapted to be driven by a drive mechanism. The endless loop 80 is adapted so that a continuous web 83, such as a print media, may travel thereon. A second embodiment of the media guide 90 is used with this second type of media advancement mechanism which is generally referred to as a tractor driven apparatus. The media guide 90 is also an integral member which is adapted to be mechanically coupled to both of the cylindrical members 81 and 82 so that they may rotate independently thereof and so that the continuous web 83 is disposed between the media guide 90 and the cylindrical sidewalls of the cylindrical members 81 and 82 of the endless loop 80. The media guide 90 may be formed out of either metal or plastic.

U.S. Pat. No. 3,825,162, entitled Feed Mechanism issued to Leo J. Hubbard on July 23, 1974, teaches the second type of media advancement mechanism as shown in FIG. 5.

From the foregoing it can be seen that an improved media guide has been described. Accordingly, it is intended that the foregoing disclosure and showing made in the drawing shall be considered only as illustrations of the present invention. Furthermore it should be noted that the sketches are not drawn to scale and that distances of and between the figures are not to be considered significant. The invention will be set forth with particularity in the appended claims.

What is claimed is:

1. A media guide for use in combination with a printer for printing on a print medium which includes:

a. a frame;

b. a pair of sprockets, each of which has a cylindrical sidewall on which the print medium travels, wherein each of said sprockets has a disc-shaped hub and is axially coupled to said frame;

c. a print head which is mechanically coupled to said frame and which travels laterally along the front of said frame;

d. a platen which is mechanically coupled to said frame and which is disposed so that the print medium may travel between said platen and said print head; and e. rotating means for rotating each of said sprockets at its axis, said media guide comprising:

a. a pair of integral members each of which is disposed adjacent one of said sprockets so that the print medium is disposed between the cylindrical sidewall of each of said sprockets and a first portion of each of said integral members and which is mechanically coupled to said disc-shaped hub of each of said sprockets through a second portion of each of said integral members so that each of said sprockets may rotate independently of each of said integral members, each of said integral members having a pair of fingers which are mechanically coupled to said disc-shaped hub of each of said sprockets being biased by a spring which resiliently couples said pair of fingers.

2. A media guide according to claim 17 wherein each of said integral members has a third portion which can be coupled to said disc-shaped hub of each of said sprockets so that said first portion of each of said integral members may be spaced apart from said print medium in order to load said print medium into said printer.

3. A media guide according to claim 2 wherein each of said pair of integral members has its first portion shaped so that an operator's finger may be easily inserted in order to lift each of said pair of integral members upward thereby spacing each of said integral members apart from said print medium.

4. A media guide according to claim 2 wherein each of said pair of integral members has a limit stop.

5. A media guide according to claim 1 wherein each of said pair of integral members is fabricated from wire.

6. A media guide for use in combination with a printer for printing on a print medium which includes:

a. a frame;

b. a pair of sprockets, each of which has a cylindrical sidewall on which the print medium travels, wherein each of said sprockets has a disc-shaped hub and is axially coupled to said frame;

c. a print head which is mechanically coupled to said frame amd which travels laterally along the front of said frame;

d. a platen which is mechanically coupled to said frame and which is disposed so that the print medium may travel between said platen and said print head; and e. rotating means for rotating each of said sprockets at its axis, said media guide comprising:

a. a pair of integral members each of which is disposed adjacent to one of said sprockets so that the print medium is disposed between the cylindrical sidewall of said sprockets and a first portion of each of said integral members and each of which is mechanically coupled to the disc-shaped hub of each of said sprockets through a second portion of each of said integral members so that said sprockets may rotate independently of said integral members, each of said integral members having a pair of resilient fingers which are mechanically coupled to the disc-shaped hub of each of said sprockets and which are disposed so that said media guide functions as a friction clutch for said sprockets.

* * * * *

UNITED STATES PATENT AND TRADEMARK OFFICE

CERTIFICATE OF CORRECTION

PATENT NO. : 4,238,160

DATED : December 9, 1980

INVENTOR(S) : Nicholas _. Kondur, Jr.

It is certified that error appears in the above-identified patent and that said Letters Patent are hereby corrected as shown below:

In claim 2, line 1, after the word claim, delete "17" and insert 1.

Signed and Sealed this

*Twenty-third* Day of *March 1982*

[SEAL]

*Attest:*

GERALD J. MOSSINGHOFF

*Attesting Officer*

*Commissioner of Patents and Trademarks*